US005479808A

United States Patent [19]

Bricmont

[11] Patent Number: 5,479,808

[45] Date of Patent: Jan. 2, 1996

[54] HIGH INTENSITY REHEATING APPARATUS AND METHOD

[75] Inventor: Francis H. Bricmont, Pittsburgh, Pa.

[73] Assignee: Bricmanage, Inc., McMurray, Pa.

[21] Appl. No.: 226,505

[22] Filed: Apr. 12, 1994

Related U.S. Application Data

[63] Continuation of Ser. No. 58,274, May 4, 1993, abandoned, which is a continuation of Ser. No. 713,523, Jun. 12, 1991, abandoned, which is a continuation-in-part of Ser. No. 621,638, Dec. 3, 1990, Pat. No. 5,082,047, which is a division of Ser. No. 387,141, Jul. 31, 1989, Pat. No. 4,991, 276.

[51] Int. Cl.[6] ..... B21B 1/46; B22D 11/12; F27B 9/02

[52] U.S. Cl. ..... 72/202; 72/364; 29/527.7; 164/477; 432/8; 432/128

[58] Field of Search ..... 29/33 C, 33 S, 29/527.6, 527.7; 72/38, 39, 200, 202, 342.1, 364; 164/476, 477, 480, 485; 432/8, 11, 128

[56] References Cited

U.S. PATENT DOCUMENTS

| | | | |
|---|---|---|---|
| 3,451,664 | 6/1969 | Alexander, Jr. | 432/11 |
| 4,022,571 | 5/1977 | Gentry et al. | 432/180 |
| 4,357,135 | 11/1982 | Wilde et al. | 432/11 |
| 4,614,495 | 9/1986 | Tabuchi | 432/128 |
| 4,675,974 | 6/1987 | Connolly | 29/527.7 |
| 4,878,839 | 11/1989 | Wunning | 432/8 |
| 5,115,547 | 5/1992 | Rohde | 72/202 |

OTHER PUBLICATIONS

Ginzburg, *Steel Rolling Technology,* 1989, Chapter 10, pp. 165–168, and Chapter 31, pp. 571–588.

SMS Schloeman Siemag, *CSP Compact Strip Production,* 1987.

*Primary Examiner*—Lowell A. Larson
*Assistant Examiner*—Thomas C. Schoeffler
*Attorney, Agent, or Firm*—Clifford A. Poff

[57] ABSTRACT

A steel workpiece reheating apparatus and method for raising the temperature of a thin continuously-cast hot workpiece to a required working temperature without causing harm to the workpiece. The apparatus includes a high intensity heating chamber provided at the charging end of a reheat furnace structure which briefly and intensely heats the workpiece above its melting temperature before it enters the remainder of the reheat furnace. The provision of the high intensity heat chamber at the charging end of the reheat furnace structure permits substantial reduction in the length normally required of the reheat furnace to raise the workpiece to the desired working temperature and thus reduces the time spent by the workpiece in the reheat furnace. The high intensity heating chamber uses in its combustion process combustion air preferably preheated by a heat recovery system associated with the heat derived from the combustion occurring within other portions of the reheat furnace. Upon combustion of the preheated combustion air with an appropriate fuel, temperatures above the melting temperature of the steel are achieved within the high intensity heating chamber. The operation of the various systems of the apparatus is fully controlled and integrated by a central computer for maximum production rate and optimum efficiency.

15 Claims, 3 Drawing Sheets

HIGH INTENSITY REHEATING APPARATUS AND METHOD

CROSS REFERENCE OF RELATED APPLICATIONS

This application is a continuation of application Ser. No. 08/058,274, filed May 4, 1993, now abandoned, which is a Continuation of Ser. No. 07/713,523, filed Jun. 12, 1991, now abandoned, which is a Continuation-In-Part of U.S. Pat. No. 5,082,047, issued Jan. 21, 1992, Ser. No. 07/621,638, filed Dec. 3, 1990, which is a Division of U.S. Pat. No. 4,991,276, issued Feb. 12, 1991, Ser. No. 07/387,141, filed Jul. 31, 1989.

BACKGROUND OF THE INVENTION

1. Field of the Invention

The present invention relates to apparatus and methods for heating steel workpieces, in general, and to apparatus and methods for rapidly heating thin continuously-cast hot workpieces to a temperature suitable for rolling, in particular.

2. Description of the Prior Art

In the past, roller-type or pusher-type hearths have been provided in furnaces to support numerous different forms of workpieces as, for example, a plurality of bars or slabs during heating within the furnace. Such workpieces are heated for a number of different reasons, all of which usually are characterized by the need to supply heated workpieces from the furnaces at a uniform temperature. The actual temperature to which these workpieces are heated depends upon the particular metalworking or treating operations but, generally, the workpieces are raised to a temperature above the critical temperature of the metal and frequently it is desired to raise the temperature of the workpiece to 2,000° F. or higher.

As can be appreciated, the greater the thickness of the workpiece, generally the more treatment is required to reduce the workpiece to a final thickness—especially if the workpiece is to be formed into thin coiled steel strip. For obvious reasons, greater numbers of thickness rolling reductions of the workpiece add to the manufacture cost and time required for forming the final product.

In an attempt to reduce the number of steps required to produce finish strip from molten steel, the practice of continuously casting thin strip has been introduced. The thin casting of the workpiece into strip eliminates the ingot-to-slab formation step and the breakdown of the slab prior to formation of the finish strip as was required by previous conventional techniques. In the application of this technology, the relatively hot continuously-cast strip must be heat-soaked for sometime as it travels through a reheat furnace in order to further heat the strip to a temperature suitable for rolling. Similarly, cold strip workpieces must also be passed through such a reheat furnace before they too can achieve a temperature suitable for rolling.

A typical reheat furnace, in cooperation with the workpiece conveyance system associated therewith, is designed to sufficiently reheat workpieces of particular maximum thickness and/or minimum thermal conductivity. That is to say, a furnace capable of providing a given maximum heat output must be of a particular minimum length and/or the workpiece conveyance system associated therewith must be capable of being operated at a particular minimum speed in order to sufficiently heat-soak the workpieces.

For sufficient heat-soaking of conventional strip-like workpieces of up to approximately 2.5 inches in thickness, the typical reheat furnace may be designed to extend for lengths of 500 feet or greater, or the workpiece conveyance system must be capable of being slowed to relatively slow speeds to properly heat-soak the workpieces.

To more effectively utilize continuously-cast thin strip technology, an advantage exists for a furnace design and heating method which will more quickly raise the strip to a suitable rolling temperature without causing harm to the strip, thereby permitting: 1) a reduction of the required length of the furnace, and/or 2) an increase in the conveyance speed of the strip conveyance system associated with the furnace. Such reduction in the required length of the furnace will reduce construction, maintenance and energy consumption costs of the furnace while at the same time reducing the time in which the strip spends in the furnace. Moreover, increasing the conveyance speed of the associated conveyance structure further reduces the time which the strip spends in the furnace. In either event, a material decrease in the time which the workpieces spend in the furnace translates to a material reduction in the time required to form the molten steel into finished strip.

The design of the furnace will preferably be of a modular construction for relatively uncomplicated and economical application to both new furnace constructions as well as for retrofitting of existing furnace constructions.

It is therefore an object of the present invention to provide a furnace design and associated heating method for rapidly and effectively heating thin continuously cast hot metal workpieces to a suitable temperature for rolling without causing harm to the workpieces.

It is a further object of the present invention to provide a furnace design and associated heating method which will reduce the required length and, therefore, the construction, maintenance, and fuel consumption costs associated with steel workpiece reheat furnaces.

It is a further object of the present invention to provide a furnace design and associated heating method which reduces the time a workpiece is required to reside in the reheat furnace in order to obtain a temperature suitable for rolling, hence reducing the time in which the workpiece may be processed into a final product.

It is yet a further object of the present invention to provide a furnace design which is of a modular construction for relatively uncomplicated and economical application to both new furnace constructions as well as for retrofitting of existing furnace constructions.

Still further objects and advantages will become apparent in light of the attached drawing figures and written description of the invention presented hereinbelow.

SUMMARY OF THE INVENTION

The present invention provides a steel workpiece reheating apparatus and method for raising the temperature of a thin continuously-cast hot workpiece to a required working temperature without causing harm to the workpiece. The apparatus includes a high intensity heating chamber provided at the charging end of a reheat furnace structure which briefly and intensely heats the workpiece above its melting temperature before it enters the remainder of the reheat furnace. The provision of the high intensity heating chamber at the charging end of the reheat furnace structure permits substantial reduction in the length normally required of the reheat furnace to raise the workpiece to the desired working temperature and thus reduces the time spent by the workpiece in the reheat furnace. The high intensity heating chamber uses in its combustion process combustion air preferably preheated by a heat recovery system associated with the heat derived from the combustion occurring within other portions of the reheat furnace. Upon combustion of the preheated combustion air with an appropriate fuel, temperatures above the melting temperature of the workpiece are achieved within the high intensity heating chamber. The operation of the various systems of the apparatus is fully controlled and integrated by a central computer for maximum production rate and optimum efficiency.

DESCRIPTION OF THE PREFERRED EMBODIMENTS

The present invention provides a reheating apparatus and method for raising the temperature of a hot, thin, continuously-cast metal, preferably steel, workpiece to a required working temperature without causing harm to the workpiece. The apparatus includes a high intensity heating chamber provided at the charging end of a reheat furnace structure which briefly and intensely heats the workpiece at a temperature above its melting temperature and, most preferably, above the melting temperature of any scale formed thereon during casting before the workpiece enters the remainder of the reheat furnace. The high intensity heating chamber at the charging end of the reheat furnace structure permits substantial reduction in the length required of the reheat furnace to raise the workpiece to the desired working temperature and thus reduces the time spent by the workpiece in the reheat furnace. Furthermore, the high intensity heating chamber uses in its combustion process combustion air preferably preheated by a heat recovery system associated with the heat derived from the combustion occurring within other portions of the reheat furnace. Upon combustion of the preheated combustion air with an appropriate fuel, temperatures at least above the melting temperature of the workpiece are achieved within the high intensity heating chamber. With such a furnace construction, the entire cross-sectional area of a metal workpiece is capable of being raised above a desired working temperature but less than the workpiece melting temperature upon exiting the high intensity heating chamber, thereby enabling relatively rapid normalization of the workpiece temperature to its desired working temperature in the remainder of the reheat furnace.

Figure 1:
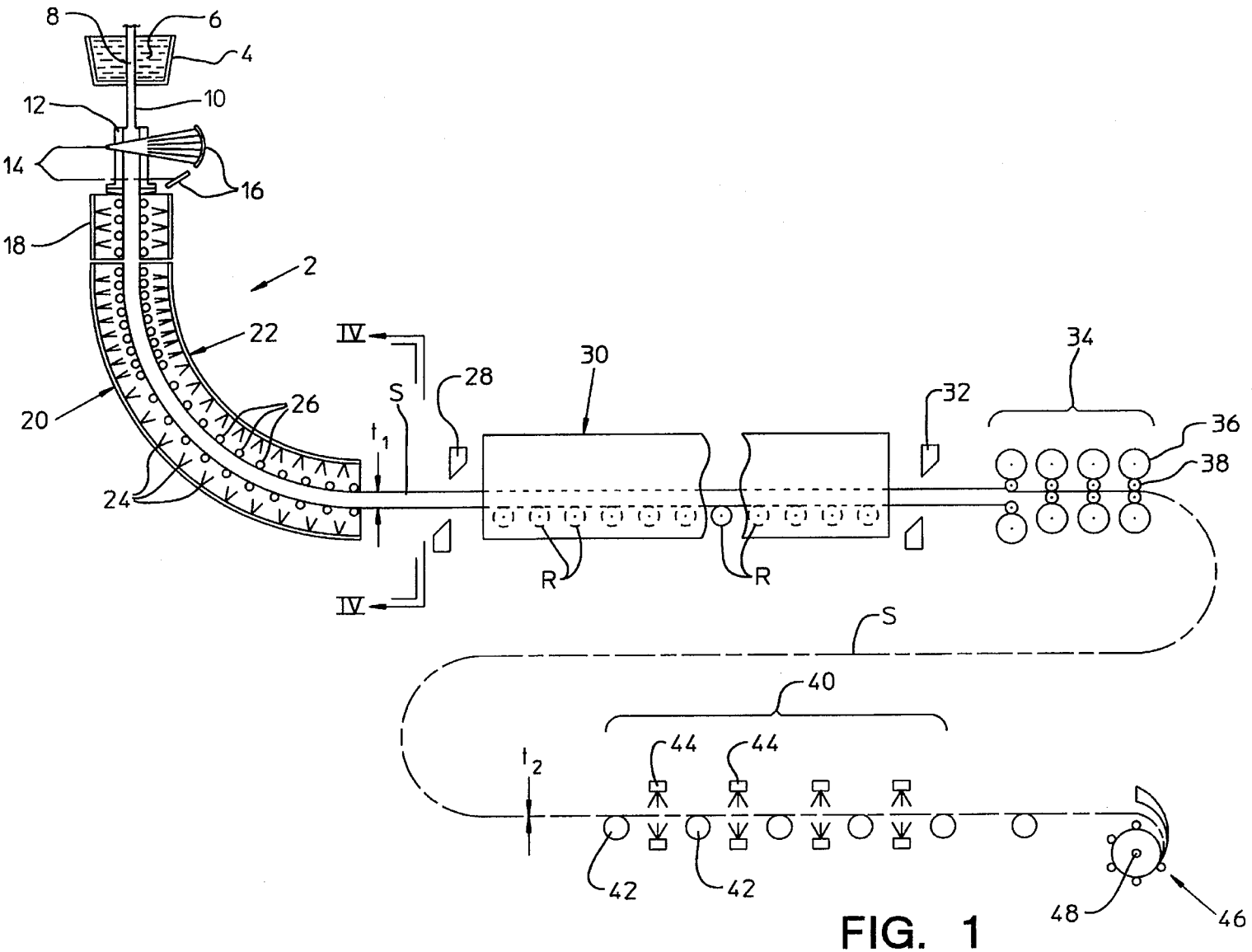
FIG. 1 is a schematic view of a continuous casting system and a reduction mill system having a reheat furnace of the present invention situated therebetween.

Depicted in FIG. 1 is a representative example of the preferred application of the furnace design and method of the present invention. All workpiece and furnace temperatures mentioned herein represent typical working temperatures used for casting and reheating thin continuously-cast steel workpieces of generally conventional composition. Such temperatures should not be construed as limitative of the present invention. That is to say, steels and other metallic workpieces of various compositions (and various working temperatures) may also gain from being treated in accordance with the broad concepts of the apparatus and method of the present invention described hereabove.

The system of FIG. 1 includes a continuous casting device 2 including a tundish 4 for containing a quantity of molten metal 6, such as steel, and a stopcock means 8 for dispensing a desired quantity of the molten metal 6 from the tundish 4. At such time when the stopcock means 8 is raised within the tundish 4, a quantity 10 of the molten metal 6 is permitted to flow by gravity into water-cooled oscillating mold 12. It is in the mold 12 that molten metal 6 first begins to solidify. A pair of gamma ray sources 14 are positioned to one side of the oscillating mold 12 and project gamma rays through the mold 12. The gamma rays are then detected by receivers 16 which determine and control the desired level of metal 6 to be maintained in the mold 12.

The metal then exits the mold 12 and enters into a first straight section 18 of a water spray cooling zone 20. Straight section 18 is secured to and oscillates with the mold 12. Below straight section 18 is a separate stationary curved section 22 of water spray cooling zone 20. As the metal passes through water spray cooling zone 20, it is sprayed by water spraying devices 26 which are provided along the entire length of the water spray cooling zone 20. The metal, which is cast so as to be formed as a strip "S", is caused to pass smoothly into the straight section 18 and then follow the curvature of the curved section 22 by virtue of contact with a plurality of pairs of opposed rollers 26 provided along the length of the water spray cooling zone 20.

Cast as a "thin" strip, the metal exits the continuous casting device 2 as a flexible yet solid strip most preferably having a thickness "$t_1$" of approximately 1.5 to 2.5 inches and between approximately 36 to 65 inches in width. At this point in time, strip "S" typically has a core temperature of approximately 1600°–1800° F. and a skin temperature of approximately 1200°–1300° F. It will be understood that the terms "core" and "skin" are relative in nature and do not nor cannot define in specificity any particular regions or boundaries of the cross-section of the strip "S". That is, the boundaries between "skin" and "core" are undefined. Therefore, for purposes of simplicity, it will be understood that there exists a continuous thermal gradient between the outer (skin) and inner (core) regions of the strip "S" at the moment it exits the continuous casting device 2 wherein the outer regions of the strip are cooler than the inner regions thereof. A better appreciation of this phenomenon may be had by reference to FIGS. 4 and 5 and their accompanying descriptions provided hereinafter.

Continuing with reference to FIG. 1, upon exiting the continuous casting device 2 the strip "S" then passes through a first flying shear 28 and then into a furnace 30 constructed in accordance with the present invention which is used to heat the strip to raise it to a working temperature on the order of 2000° F. to 2200° F. Furnace 30 of the present invention, possessing novel and advantageous features to be described hereinbelow, is generally less than approximately 250 feet in length which is significantly less than the 500 to 800 feet lengths which are commonly required for conventional prior art thin cast strip reheat furnaces. As can be appreciated, such a substantial reduction in the length of the reheat furnace 30 produces correspondingly material reductions in its construction, maintenance and fuel consumption costs.

Figure 3:
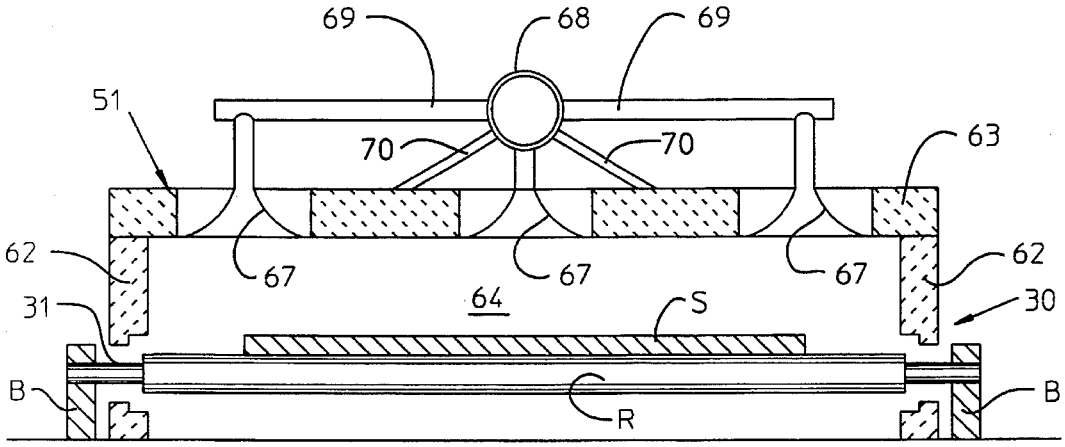
FIG. 3 is a sectional view of the reheat furnace of the present invention taken along line III—III of FIG. 2.

In accordance with the present invention, the strip "S" is conveyed and guided through the furnace 30 by means of a plurality of driven roller means "R" as shown in FIG. 1 which are preferably of the type of flexible workpiece conveyance rollers disclosed in my co-pending U.S. patent application Ser. No. 387,141, filed Jul. 31, 1989, now U.S. Pat. No. 4,991,276, the disclosure of which is incorporated herein by reference. Such rollers assume a catenary shape along their longitudinal axes under the weight of a workpiece (FIG. 3). Hence, the rollers "R" provide continuous transverse support and positively guide thin flexible strips such as strip "S" as they pass through a reheat furnace. Rollers such as those described in the aforesaid U.S. patent application Ser. No. 387,141 are most advantageously used to convey the previously described "thin" strip since such strip has limited structural integrity, i.e., it becomes quite flexible when heated to the working temperatures of the reheat furnace. As such, the "thin" strip cannot be effectively transported using other conventional workpiece conveyance structures which provide spaced transverse support for workpiece, e.g., walking beams or the rails of a pusher-type furnace.

Figure 2:
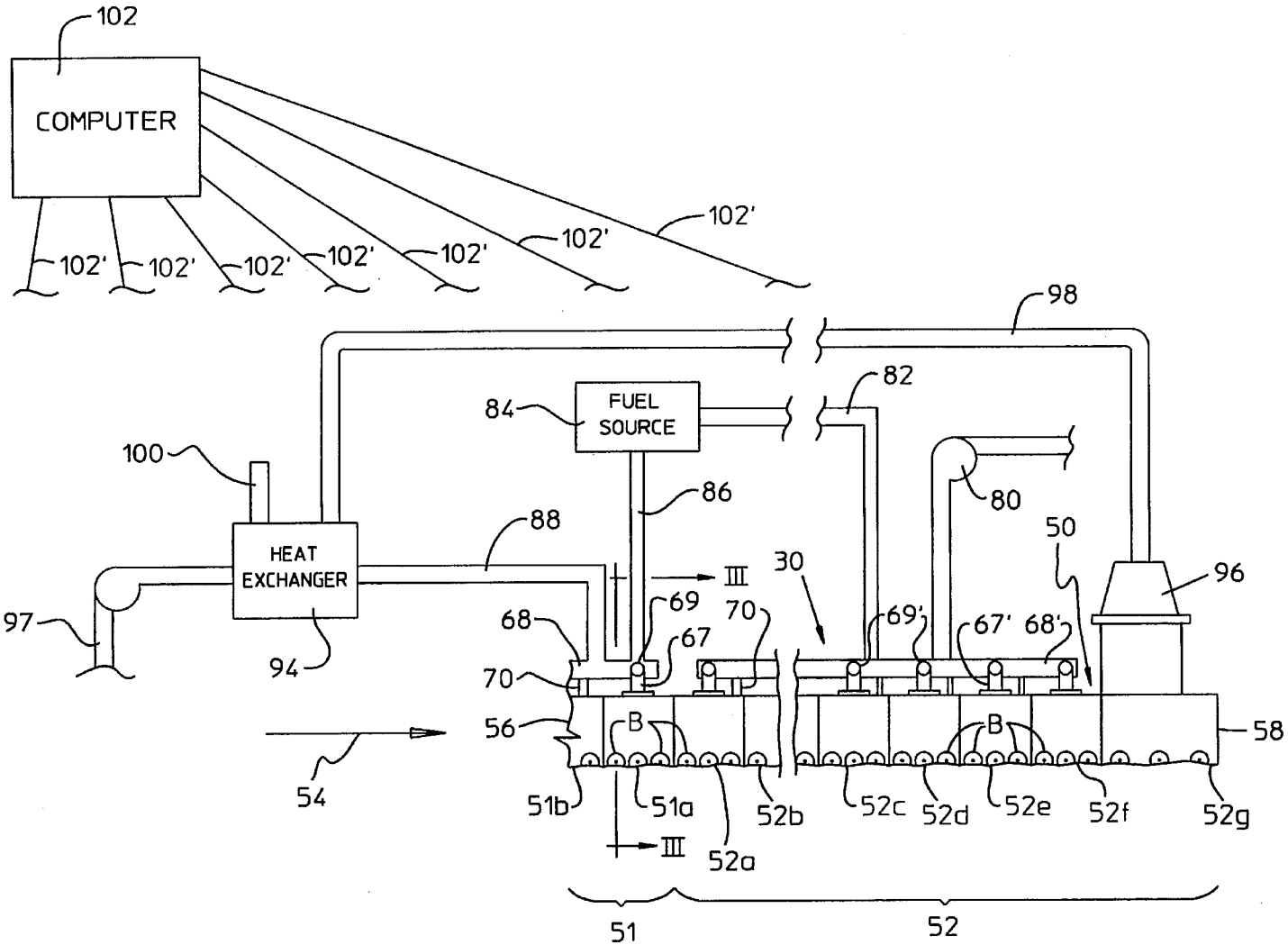
FIG. 2 is a side view of the furnace of the present invention as well as a schematic view of the preferred heating system to be used with the furnace.

As can be seen most clearly in FIGS. 2 and 3, rollers "R" are carried on shafts 31 which are rotatably supported at their opposite ends by bearings "B". Means (not illustrated) for driving the rollers "R" are also provided at first ends of the rollers in order to positively convey the strip "S" through the furnace 30.

Continuing with the description of FIG. 1, and further describing in a general nature the subsequent processing of "thin" continuously cast strip, it can be seen that as the strip "S" exits furnace 30 it passes by a second flying shear 32 and then to a finishing train 34. Rolling mill train 34 is formed of a plurality of four-high rolling mill stands each having back-up rolls 36 and working rolls 38. After treatment by the finishing train 34 the strip is reduced to a thickness which is suitable for coiling on a coiled mandrel. Preferably the strip emerging from the finishing train is reduced for coiling from approximately 1.5 to 2.5 inches down to a thickness "$t_2$" of approximately 0.1 to 0.6 inches. The shears 28 and 32 allow for severing the strip during normal operation so as to limit the finished strip coil size or for maintenance operations.

The number of rolling mill stands used in the finishing train 34 can be varied as desired depending on the thickness of the strip as-cast and the final desired "after-rolling" thickness of the strip.

From the finishing train 34 the strip is delivered to a run-out table 40 having driven conveyor rollers 42. Also associated with run-out table 40 are a plurality of water spraying devices 44 which provide a final cooling treatment to the strip "S" before it is coiled by a conventional down-coiler 46 having a collapsible mandrel 48.

As can be seen in FIG. 2, furnace 30 comprises an elongated housing or enclosure 50 consisting of a high intensity heating portion 51 and downstream thereof a heat soaking or normalizing portion 52 forming a contiguous opening to accommodate movement therethrough of strip "S" as upon rollers "R" for heating the strip. According to the present invention, the portion of the furnace enclosure forming a high intensity chamber 51 is comprised of at least one module 51A and possibly more modules such as 51B, etc. The portion of the furnace enclosure forming the downstream heat soaking chamber 52 is likewise preferably formed of a plurality of modular segments 52A, 52B, 52C, 52D, 52E, 52F, 52G, etc.

The length of each enclosure module may be approximately eight to ten feet, for example, and the respective modules are preferably secured together end-to-end by any suitable fasteners to form the elongated furnace enclosure 50. Strip "S" passes in the direction of arrow 54 through the charging end 56 of portion 51 and is discharged through exit 58 of portion 52.

Additional structure and function of portions 51 and 52 of furnace enclosure 50 are described in greater detail hereinbelow.

With specific reference to FIG. 3, there is shown a cross-sectional view, generally simplified and schematic in form, of the module 51A of the high intensity heating chamber portion 51 of reheat furnace 30 of the present invention. The module preferably incudes vertically upstanding side walls 62 and a roof 63. Roof 63 bridges the side walls to form an elongated enclosed space 64 through which workpieces such as strip "S" are transported as by rollers "R" for reheating of strip "S". Walls 62 and roof 63 are lined with suitable refractory brick, or the like. To supply heat to this section of furnace 30 there is provided a plurality of flat flame burners 67 which penetrate roof 63 to provide an oxidant such as air and hydrocarbon fuel mix for combustion within space 64. The air and fuel mix is provided to burners 67 via a heat exchange system and a fuel source to be described hereinbelow and header 68 and manifold systems 69. Atmospheric air or oxygen or a combination of air and oxygen are suitable oxidants. Suitable supports such as partially shown at 70 are provided to support the header 68 and the manifold systems 69. As noted above, the burners 67 are preferably of the "flat flame" variety. That is, they should produce a "soft" relatively diffuse flame within space 64. The heat soaking portion 52 is preferably of similar modular construction. However, the heat-soaking portion 52 may utilize other well-known constructions.

Referring back to FIG. 2, it can be seen that header 68' for heat soaking chamber 52 receives its combustible fuel mixture via air blower 80 and fuel line 82 which communicates fuel from fuel supply 84. The air/fuel mixture is then communicated from header 68' via at least one manifold 69' which delivers the mixture to a plurality of burners 67'. Fuel supply 84 further serves as the fuel supply for high intensity heat chamber 51.

As stated previously, high intensity heat chamber 51 forms a portion of furnace enclosure 50 and serves as a means for briefly and intensely heating a workpiece such as strip "S" before it makes its passage through the heat soaking or normalizing portion 52 of furnace enclosure 50 formed by modules 52*a*, 52*b*, etc. And, as previously stated, chamber may be formed by one or more modules 51*a*, 51*b*, etc., as required, depending on the maximum thickness and/or minimum thermal conductivity of strip to be passed through and heated in furnace enclosure 50.

The melting temperature of a steel of conventional composition is typically on the order of about 2500° F. and the scale formed on such steel during thin continuous casting thereof melts at a temperature of about 2750° F.

Workpiece heating temperatures attained within heating chamber 51 may be on the order of about 2800° F. which is above not only the melting temperature of conventional steels but also that of the scale formed thereon during continuous casting. Furthermore, such temperatures are typically approximately 600° F. to 800° F. higher than the maximum normal workpiece heating temperatures provided by prior conventional reheat furnace structures or, for that matter, the heat soaking portion 52 of furnace enclosure 50 downstream of chamber 51. The normal workpiece heating temperature of conventional reheat furnace structures for reheating conventional steels corresponds substantially to the required rolling temperature for the workpiece upon exiting the reheat furnace, i.e., approximately 2100°–2200° F.; and in such conventional furnaces, this working temperature is virtually constant throughout the length of the furnace. A workpiece passing through such furnaces, therefore, gradually reaches the proper rolling temperature only after a rather lengthy "heat-soak" time period spent in the reheat furnace.

Through the present invention, it has been discovered that because of the unique thermodynamics of thin, hot, continuously-cast steel strip, such strip can be passed through a high intensity heating chamber operating at a temperature of about 2800° F. (such as chamber 51) at a controlled rate of speed to rapidly raise the temperature of the entire cross-sectional area of the strip whereby it exits the chamber 51 at about 2400° F. without experiencing either "breakout", melting of the skin of the strip, or other harming of the strip. Furthermore, the 2400° F. temperature at which the strip "S" exits the high intensity heating chamber 51 and enters the heat soaking chamber 52 is typically on the order of about 200°–400° F. higher than the required rolling temperature of the strip (and the temperature within heat soaking chamber 52).

A particular object and a specific advantage of the furnace structure 50 of the present invention, therefore, is that it materially reduces the length of furnace enclosure required to for a workpiece to obtain a proper working temperature. Such reduction in furnace length accordingly translates to a reduction in the time required for the workpiece to heat soak to obtain its working temperature. Consequently, a significant portion of the construction, maintenance, and energy consumption costs associated with conventional reheat furnace structures is avoided by virtue of the novel furnace construction of the present invention. In accordance with other applications of the present invention, it is also contemplated that existing reheat furnace structures may be retrofitted with a high intensity heating chamber, such as chamber 51, at the charging ends thereof. Burners may be arranged above and below the strip to supply heat to both the top and bottom surfaces of the strip. In such case, the existing "conventional" portions of such furnaces may be reduced in length and/or the workpiece conveyance systems associated therewith can be operated at higher speeds than presently possible in order to reduce the time required to pass the workpieces through the furnaces so that the workpieces may be more rapidly converted into final product such as finished strip.

When exposed to temperatures on the order of 2800° F., workpieces such as thin, hot, continuously-cast strip of less than approximately 2.5 inches in thickness are relatively rapidly heated to temperatures above their targeted working temperatures such that their entire cross-sectional areas quickly normalize or equalize to the working temperatures (approximately 2200° F.) of the remaining portion 52 of the furnace enclosure 50, which substantially corresponds to the required rolling temperature for the workpieces. However, as will be described herebelow, the workpieces cannot be continuously exposed to the intense temperatures present in chamber 51 throughout the length of furnace enclosure 50 because in a short period of time the workpieces will begin to liquify, first at their skins and then proceeding through to their interiors.

Figure 4:
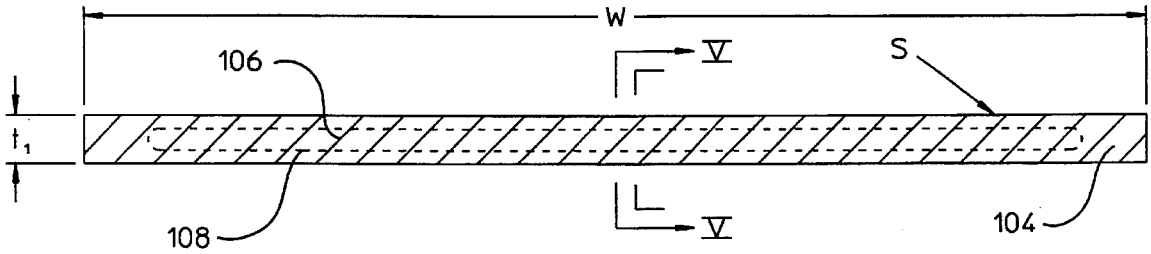
FIG. 4 is a cross sectional view of a thin continuously-cast strip workpiece taken along line IV—IV of FIG. 1.
Figure 5:
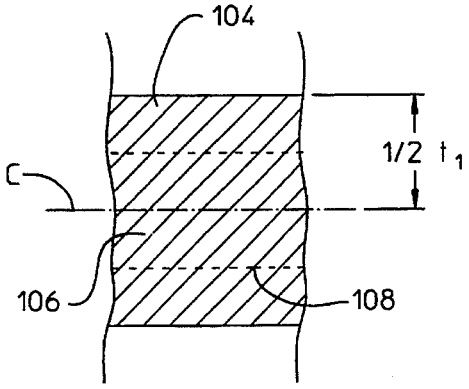
FIG. 5 is an enlarged sectional view of an incremental length of a thin continuously-cast strip workpiece taken along line V—V of FIG. 4.

FIGS. 4 and 5 depict in somewhat simplified fashion the thermodynamic characteristics of a hot, thin, continuously-cast metal strip "S" as it exits the continuous casting device 2. As noted hereinabove, the strip exits the caster 2 as a flexible yet solid strip at a thickness "$t_1$" of approximately 1.5 to 2.5 inches and having a width "w" between approximately 36 to 45 inches. The aforementioned "skin" and "core" of strip "S" are herein designated by the numerals 104 and 106, respectively, and are distinguished from one another by an arbitrarily located thermal boundary designated by dotted line 106. Discrete temperature boundaries between the skin 104 and core 106 do not actually exist. That is to say, there is a continuum or temperature gradient between the "skin" or out regions of the strip and the "core" or inner regions thereof. A possibly more realistic although materially more complicated representation of such a temperature gradient would have been to include in FIGS. 4 and 5 several isothermal lines such as dotted line 108 to indicate the gradual increase in temperature which occurs from the skin 104 to the core 106. However, for purposes of simplicity in both illustration and description, the thermodynamic effects occurring in a hot, thin, continuously-cast strip during reheating in the reheat furnace 30 of the present invention will be described via the effects experienced by the basic skin add core regions 104 and 106 shown in the strip "S" of FIGS. 4 and 5.

The distance from the surface to the center "C" of the hot strip "S" as it exits the continuous casting device 2 is ½ $t_1$. And, in the present example, such distance is approximately 0.75 to 1.25 inches. As previously mentioned, the temperature of the skin 104 for a typical steel at this particular point in time is typically about 1200°–1300° F. and the core 106 is at a temperature of approximately 1600°–1800° F. Thus, in as little as about 0.75 inches in thickness a typical thin continuously-cast steel strip may vary up to about 600° F. in temperature, thereby representing a potential temperature gradient of up to about 800° F. per inch of thickness from the surface to the center "C" of strip "S".

In the normal cooling process of a body which is warmer than its environment, the body continually radiates heat outwardly into its environment until the body reaches an equilibrium temperature which equals that of its environment. Bearing this in mind, it will be appreciated that while the skin 104 is continuously losing heat to the environment it is also continuously receiving heat from the relatively higher temperature core 106. Simultaneously, when passing through high intensity heating chamber 51 the skin 104 also receives, for a brief period, heat which is at a temperature above the melting temperature of the strip and, preferably, above the melting temperature of any scale which may be present on the exterior of the strip. Thus, the skin is heated both from the innermost regions of the strip as well as by the furnace. The skin 104 is therefore quickly raised to a target temperature, e.g., 2400° F., above the rolling temperature of approximately 2100°–2200° F. and this situation in turn causes heat flow from the core to be reversed, i.e., the core begins to rapidly receive heat, whereby the entire cross-sectional area of the strip quickly attains the desired target temperature.

A unique characteristic arising from heating an already hot thin strip workpiece in a high intensity heating chamber such as chamber 51 is that although the workpiece is exposed to temperatures higher that its melting temperature, it is not damaged by surface liquidization or breakouts, and the like, because it can be passed relatively rapidly through such a chamber. This is because the intense heat in chamber 51, as described hereabove, can penetrate quickly to the center of the strip due to the relative thinness of the strip and also because the strip is already somewhat heated entirely therethrough. Therefore, much less energy and much less time is required to raise the hot strip "S" to a temperature above its rolling temperature than would be required, for example, if the workpiece were cold or were relatively thick. In such instances, in order for the workpiece to attain a consistent temperature throughout its cross-sectional area that is above its rolling temperature by way of exposure to temperatures above its melting temperature, the workpiece would require much more heating energy and therefore would have to reside in the high intensity heating chamber for a somewhat extended length of time, hence resulting surface melting, breakouts, or other damage to the workpiece.

A critical factor, therefore, for preventing damage to a workpiece passing through the furnace 30 of the present invention, particularly high intensity heating chamber 51 thereof, is the speed at which the workpiece is passed through the furnace. The only type of workpiece which thus far has exhibited the proper thermodynamic and material strength characteristics for enabling sufficiently rapid passage through high intensity heating chamber 51 is a hot, thin, and preferably recently continuously-cast workpiece having a thickness on the order of about 1.5 to 2.5 inches in thickness.

The length of chamber 51 and/or the workpiece conveyance speed is thus preselected such that as the workpiece or strip "S" exits chamber 51 and enters the remaining heat-soaking portion 52 of furnace enclosure 50 the outer surface of the skin of the workpiece has not yet begun to liquify and, at the same time, the entire cross-section of the workpiece has been heated to a temperature above the rolling temperature for the workpiece, which substantially corresponds to the working temperatures generated in the remaining portions of the furnace, i.e., heat soaking portion 52. Consequently, the heat soaking portion 52 of the furnace serves as a "temperature equalizing" chamber for permitting the entire workpiece to obtain the aforesaid working temperature. In other words, little or no raising of the temperature of the innermost regions of the workpieces is performed by the heat soaking portion 52 of furnace enclosure 50. In contrast, conventional reheat furnace structures require their full lengths to raise the entire cross-sectional areas of the workpieces to the necessary working or rolling temperature thus necessitating great lengths for the furnaces and proportionately high energy consumption, maintenance costs, and the like.

From the foregoing and from the following, it will be appreciated that the provision of a high intensity heating chamber, such as chamber 51, at the charging end of reheat furnace structures serves as an efficient and effective means for reducing the costs and time associated with forming strip-like workpieces into finished strip.

Continuing with FIG. 2, it is seen then header 68, which is separate from header 68', is connected by at least one manifold 69 to chamber 51 and receives its combustible fuel mixture via fuel line 86 and air line 88. Air line 88 carries preheated and pressurized air from heat exchanger or recuperator 94. Heat exchanger 94, in turn, receives its supply of air to be preheated from a blower 97. It is the air received from blower 97 which is ultimately used as the preheated and pressurized combustion air in chamber 51. The means for supplying heat to the heat exchanger 94 for the purpose of preheating the combustion air is preferably a heat recovery system connected to the heat soaking portion 52 of furnace enclosure 50.

Hot exhaust gases produced from the combustion within the portion 52 of furnace enclosure 50 are collected and delivered through exhaust stack 96 mounted in the illustrated embodiment to the exit module **52*g*. From stack 96 the hot exhaust gases are conveyed along line 98 to interior heating piping (not shown) housed within heat exchanger 94. As is conventional in the operation of heat exchangers, heat from the hot exhaust gases serves to heat the piping in heat exchanger 94 which, in turn, serves to preheat the air supplied from blower 97. The means for permitting the flow of the hot gases from stack 96, through line 98 and through heat exchanger 94 is stack 100 fitted to the exhaust portion of the heating piping of the heat exchanger. The open stack 100 thus permits convectional heat flow of the hot exhaust gases from the interior of the modules 52*a*, 52*b*, etc. to the exit opening of the stack 100 whereat the low-level residual heat of combustion not used by the heat exchanger 94** is released harmlessly to the atmosphere. When oxygen or an air-oxygen mixture is used for the combustion of fuel, the recovery of heat may be particularly advantageous to form a heat supply for other processes.

In accordance with the present invention, combustion air preheated in the heat exchanger 94 is heated to a desired combustion air temperature whereat fossil fuel combustion efficiency is maximized and ambient combustion temperatures produced within the chamber 51 reach the intended high intensity temperatures, i.e., temperatures greater than the strip melting temperature, needed to rapidly raise the temperature of the strip "S" to a temperature higher than its ultimate rolling temperature.

To summarize, the heat exchanger 94 advantageously recycles the heat from the combustion within modules **52*a*, 52*b*, etc., to preheat the combustion air supplied from blower 97**, and thus provides a means for preheating the combustion air which requires no energy consumption.

Also, schematically depicted in FIG. 2 is a computer 102 which is connected through a plurality of circuits 102' to control and integrate the operation of the blowers 80 and 97, the burners 67 in high intensity heating chamber 51, the burners in the heat soaking chamber 52, pumps (not shown) associated with fuel source 84, the driving means for rollers "R", etc. With computer 102, the various production, workpiece charging, and fuel burning rates required for most efficiently heating hot, thin, continuously-cast strip are continuously monitored and integrated to provide a workpiece reheat furnace operation of maximum production rate coupled with optimum fuel efficiency.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A method for treating a hot, thin metallic strip workpiece having a first thickness, said method comprising:

(a) continuously casting liquid metal in a fluid cooled mold to form a flexible yet solid strip workpiece having a first thickness within the range of 1.5 and 2.5 inches and having a temperature gradient between a solid skin region and a relatively hotter core region;

(b) heating said workpiece having said relatively hotter core region while continuously conveying and guiding said workpiece at a controlled rate of speed in a first furnace portion commencing at a charging end operating at a first temperature above the melting temperature of said workpiece to rapidly initially raise the temperature of said solid skin region of said workpiece to thereby reverse the flow of heat from the core region to the skin region and cause heating of the core region by conducting heat transfer from the skin region;

(c) heating said workpiece while continuously conveying and guiding said workpiece at a controlled rate of speed in a second furnace portion operating at a second temperature less than said first temperature to heat-soak said workpiece in order to cause said workpiece to attain a desired rolling temperature therethrough; and (d) rolling said workpiece after heat-soaking thereof in said second furnace portion without further heating of the workpiece to reduce said workpiece from said first thickness to a lesser second thickness.

2. The method of claim 1 further comprising performing heating step (c) for a significantly greater time duration than heating step (b).

3. The method of claim 1 wherein heating step (b) comprises raising the temperature of the entire cross-sectional area of said workpiece to a temperature above said desired rolling temperature.

4. The method of claim 1 wherein said workpiece is continuously-cast steel strip.

5. The method of claim 1 wherein said first temperature is approximately 2800° F. and said second temperature is between approximately 2000° F. and 2200° F.

6. The method of claim 1 wherein said heating step (b) comprises:

preheating air to be used for combustion in said first furnace portion;

mixing said preheated air with a combustible fuel;

burning said mixed preheated air and said combustible fuel in said first furnace portion.

7. The method of claim 6 wherein said step of preheating air further comprises collecting hot exhaust combustion gases produced from heating step (c) and using said hot exhaust combustion gases to preheat said air to be used for combustion in said first furnace portion.

8. The method according to claim 1 including the further step of cutting said workpiece at said first thickness to a desired length for said rolling step (d).

9. The method according to claim 8 wherein the temperature of said solid skin region of the workpiece at said first thickness is about 1200° F. at the beginning of said heating step (b).

10. The method according to claim 1 including the further step of using a driven roller conveyor to transport said workpiece during said heating step (b) and said heating step (c).

11. A system for treating a hot, thin steel strip workpiece, said system comprising:

a continuous caster including a fluid cooled mold with an open end mold cavity dimensioned to form a flexible yet solid strip workpiece having a thickness within the range of 1.5 to 2.5 inches and a temperature gradient between a solid skin region and a relatively hotter core region;

a furnace assembly including a workpiece charging end, a high intensity heating portion beginning at said workpiece charging end, and a heat-soaking portion following said high intensity heating portion and extending to a workpiece discharging end, said furnace further including means for continuously conveying and guiding at a controlled rate of speed, said high intensity heating portion operating at a first temperature above the melting temperature of said hot workpiece to rapidly initially raise the temperature of the cross sectional area of said workpiece having said temperature gradient by reversing the flow of heat from the core region to the skin region and causing heating of the core region by conducting heat transfer from the skin region and said heat-soaking portion operating at a second temperature less than said first temperature to heat-soak said workpiece in order to cause said workpiece to attain a desired rolling temperature therethrough; and means for rolling said workpiece after exit thereof through said workpiece discharging end.

12. The system of claim 11 wherein said furnace further includes:

a fuel source in communication with said high intensity heating portion and said heat-soaking portion;

a first header and manifold system associated with said high intensity heating portion;

a second header and manifold system associated with said heat-soaking portion;

first means connected to said first header and manifold system for delivering combustion air to said first header and manifold system; and second means connected to said second header and manifold system for delivering combustion air to said second header and manifold system.

13. The system of claim 12 wherein said first means for delivering includes:

blower means for delivering said combustion air under pressure to said first header and manifold system; and means for preheating said pressurized combustion air delivered by said blower means.

14. The system of claim 13 wherein said means for preheating comprise:

means for collecting hot exhaust gases from combustion performed in said heat-soaking portion; and heat exchanger means connected to said means for collecting, said heat exchanger means using said hot exhaust gases to preheat said combustion air delivered by said blower means.

15. The system of claim 11 wherein said high intensity heating portion raises the temperature of entire cross-sectional area of said workpiece to a temperature above said desired rolling temperature.

* * * * *